United States Patent [19]

Steffen

[11] Patent Number: 4,583,764

[45] Date of Patent: Apr. 22, 1986

[54] WORKING FOLDER

[76] Inventor: Fritz Steffen, Mühlenweg 22, 4902 Bad Salzuflen 1, Fed. Rep. of Germany

[21] Appl. No.: 607,942

[22] Filed: May 7, 1984

[30] Foreign Application Priority Data

May 7, 1983 [DE] Fed. Rep. of Germany ..... 3316828

[51] Int. Cl.[4] ..... B42D 3/00; B42D 3/02

[52] U.S. Cl. ..... 281/31; 281/29; 281/35

[58] Field of Search ..... 281/17, 29, 31, 32, 281/35, 37; 40/16 R, 159, 359, 403, 404, 405; 229/68, 72, 92.8

[56] References Cited

U.S. PATENT DOCUMENTS

| | | | |
|---|---|---|---|
| 956,861 | 4/1910 | Levey | 281/35 |
| 1,549,501 | 8/1925 | Patrick | 281/31 |
| 2,178,404 | 10/1939 | Powter et al. | 281/29 |
| 2,318,278 | 5/1943 | Arnold | 229/72 |
| 3,371,850 | 3/1968 | Gorman | 40/359 |
| 3,788,540 | 1/1974 | Sammons | 229/72 |
| 3,858,790 | 1/1975 | Humphrey | 229/72 |
| 3,858,791 | 1/1975 | Gendron | 229/72 |
| 3,971,507 | 7/1976 | Stevenson | 229/72 |
| 4,058,251 | 11/1977 | Stevenson | 229/72 |

FOREIGN PATENT DOCUMENTS

| | | |
|---|---|---|
| 1816323 | 5/1960 | Fed. Rep. of Germany . |
| 1890229 | 12/1963 | Fed. Rep. of Germany . |

*Primary Examiner*—Paul A. Bell
*Assistant Examiner*—Paul M. Heyrana, Sr.
*Attorney, Agent, or Firm*—Howard M. Ellis; Michael L. Dunn

[57] ABSTRACT

A working folder comprises first and second cover panels folded one upon the other with the panels being joined to each other through a common fold edge. The folder also includes a cut-out portion in the second cover panel and a pocket panel which forms an insertion pocket together with the first cover panel; the edge of the cut-out portion in the second cover panel overlaps at least one edge of the pocket panel in the first cover panel. The folder can be fabricated with minimal waste of material and with a minimal number of fabrication steps.

10 Claims, 2 Drawing Figures

WORKING FOLDER

The invention relates to a working folder comprising two cover panels which are connected together along one of their edges and which are folded one upon the other, and a pocket panel which with the one cover panel forms an insertion pocket and which is integrally connected to the one cover panel by way of a fold edge along at least a part of an edge of the one cover panel, which adjoins the common fold edge of the two cover panels, said pocket panel being secured to the same cover panel along at least a further one of its edges.

Figure 1:
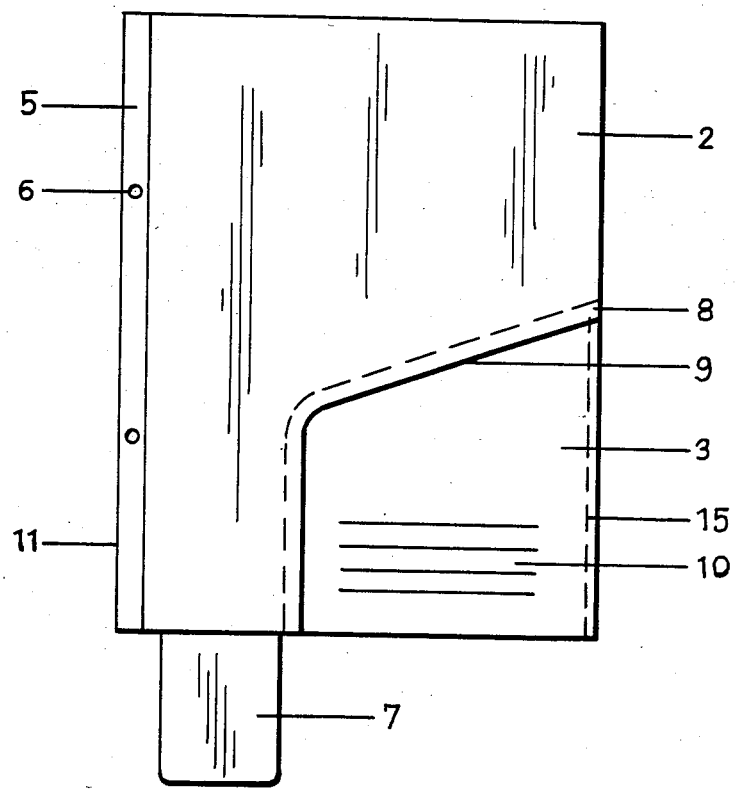

Working folders of that kind are disclosed in FIG. 1 of German Utility model specification No. 1 890 229. German Utility model specification No. 1 816 323 discloses similar working folders in which however, in the blank, the pocket panel adjoins a fold edge which extends parallel to the common fold edge of the two cover panels. Such folders are used for temporarily storing individual papers or for transmitting individual papers to other people, in which respect it is the usual practice for such folders to be labelled or written upon, on the outside of one of the cover panels, in order more easily to provide information about the content of the folder. For example, working folders of that kind are used by workmen or architects for keeping together individual sheets of sketches or working drawings of a commission until the commission has been completed, or for handing over such documents only in conjunction with each other, without having to fasten the individual sheets together. In trade and industry, particularly in manual work, they are used as in-progress folders when dealing with orders and commissions. In attorney offices, such folders are used in many cases to keep together documents which have been supplied by clients, before making them into a definitive file. In clinics, such folders are used for example for carrying X-ray films or as in-progress folders when a patient is required to attend at a plurality of wards or consultations in succession. Such working folders are frequently also used for supplying conference material to people attending conferences, for supplying company prospectuses to visitors to trade fairs, or for supplying town and hotel guides for groups of visitors to a town.

In all cases, such folders are used only for a relatively short period of time for accommodating individual sheets, prospectuses and the like, and are then thrown away. That means that such folders must be economical in regard to production and in regard to the amount of material used.

The blanks of known folders of that kind suffer from the disadvantage that, because the pocket panel is in one piece with one of the cover panels, such folders result in an undesirably high rate of waste, that is to say, scrap material, so that only poor use is made of commercially available sheets of cardboard and a relatively small number of working folders can be produced from a sheet. Having regard to the large amounts of waste material, such folders are therefore relatively expensive to produce and costly to sell.

The object of the present invention was that of providing working folders of the kind set out in the opening part of this specification, which can be produced with the minimum amount of wastage. It is also desirable to be able to produce such folders on an automatic machine with the minimum number of working operations.

The working folder according to the present invention comprises first and second cover panels folded one upon the other, the panels being connected along one of their edges to form a common fold edge. The folder includes a pocket panel with the first cover panel forming an insertion pocket in the first cover panel and a cut-out portion in the second cover panel. The pocket panel is integrally connected to the first cover panel by means of a fold edge along at least a part of an edge of the first cover panel. The pocket panel is secured to the first cover panel along at least one further edge of the first cover panel. The edge of the cut-out portion in the second cover panel overlaps at least one edge of the pocket panel.

Working folders with those features can be produced with minimum wastage as two respective blanks can be positioned relative to each other in such a way that the pocket panel of one blank engages into the cut-out portion in the other blank. In consideration of the DIN A 4 format of papers which are usually to be put in such a folder, eight blanks can be produced from a normal sheet which is 100×140 cm in size, making optimum use of the area of the sheet. That considerably reduces the cost of production of such folders as the amount of cardboard wasted is reduced to a minimum.

In addition, such folders enjoy the advantage that it is possible to mark or write on the pocket panel and such writing or marking can be read both in the closed and in the opened conditions of the folder so that, when studying the documents, with the folder in the open condition, the cover panel does not have to be first turned over if any of the writing on the outside is to be read. In addition, as will be appreciated, it is possible also to write or mark on the back and on the inward and outward sides of the front cover panel.

The working folders according to the invention are also particularly easy to produce. In a first working operation, the blank, including possibly the holes, referred to hereinafter, in the fixing edge, is punched out and simultaneously riveted where the folder is grooved. The second working operation comprises grooving the material and at the same time one edge of the pocket panel is glued or attached to the first cover panel on to which the pocket panel was folded, together possibly at the same time with the fixing edge. All three working operations can be carried out on an automatic machine.

The pocket panel may be of widely varying shapes and may extend either only over a part or over the entire length of the edge of the first cover panel to which it is connected. Thus, the pocket panel may be of a square or rectangular configuration and the shape of the two free edges of the panel may be any desired shape such as curved. Desirably, the pocket panel is of a trapezoidal configuration, with the base lines of the trapezium being disposed parallel to the common fold edge of the two cover panels, with one side of the trapezium being normal to the base lines and forming the fold edge by way of which the pocket panel is connected to the first cover panel. Such a configuration of the pocket panel ensures that the papers which are pushed into the pocket are firmly located therein, without the first cover panel having to be made too small.

Desirably, the pocket panel extends only over a part, such as 50 to 75%, of the edge of the adjoining cover panel, which edge adjoins the common fold edge of the two cover panels, as that is totally sufficient for the papers to be securely held in the pocket, and that stabilises the front cover.

It is important for the cut-out portion of the second cover panel to overlap the first cover panel, at least at one edge of the cut-out portion, as otherwise the cut-out portion and the pocket panel could become hooked together. It is desirable for the cut-out portion with its two free edges, to overlap the two edges of the pocket panel. In itself, there may not be any critical limit in an upward direction in regard to the width of overlap, but, if the width of overlap is excessive, the wastage of material is increased while if the width of overlap is too small, there is still the danger of hooking. Preferably, the cut-out portion overlaps the edge of the pocket panel by a width of about 0.5 to 3 cm, particularly preferably over a width of from 1 to 2 cm. It will be appreciated that the width of overlap does not need to be the same over the entire length of the edge of the cut-out portion.

For many purposes, there is no need for the working folder to have a fixing or filling edge, as for example when the folder is used for transmitting or handing over prospectus material or the like. In other cases, when the folder is intended to contain for example working papers for a job or the like, it is desirable in many cases for the folder alternatively to be such that it can be filed in a filing system. In that case, it is advantageous for the two cover panels to have a perforated fixing or attachment edge along their common fold edge. That fixing edge has perforations based on the normal filing systems, generally with two to eight holes. In order to stabilise the fixing edge, the two fixing edges of the two cover panels, which edges are disposed one upon the other in plane-parallel relationship, are glued together or are joined together in some other manner, as by wire stitches or staples or the like. It is particularly desirable for the fixing edge to be secured by adhesive in one working operation with the step of fixing the pocket panel to the first cover panel. It will be appreciated that alternatively the pocket panel may also be secured to the adjoining cover panel by staples or the like.

The provision of the fixing edge requires only a small amount of extra material, in return for which however the folder can perform an additional function.

In certain uses, in particular in attorney practices or the like, it is often desirable for the folder to be additionally provided at its lower edge with a labelling or marking strip or tab which projects therefrom, in order thereby to eliminate the risk of the folder disappearing between other files. If that is required, it is desirable for the pocket panel to extend only over a part of the edge of the first cover panel, which adjoins the common fold edge of the two cover panels, with a lettering or marking strip or tab being integrally connected to that cover panel at least over a part of the remainder of the above-mentioned edge adjoining the common fold edge of the two cover panels. Desirably, the strip or tab is directly adjoining the adjacent pocket panel. Desirably, the labelling or marking strip or tab is also grooved or notched at its common edge with the adjacent cover panel in the operation of grooving or notching the fold edge of the pocket panel and the other fold edges so that the marking or labelling strip or tab, in the condition of the folder in which it is ready for delivery, is in a position of being folded inwardly between the two cover panels and is only folded out when the folder is brought into use.

Figure 2:
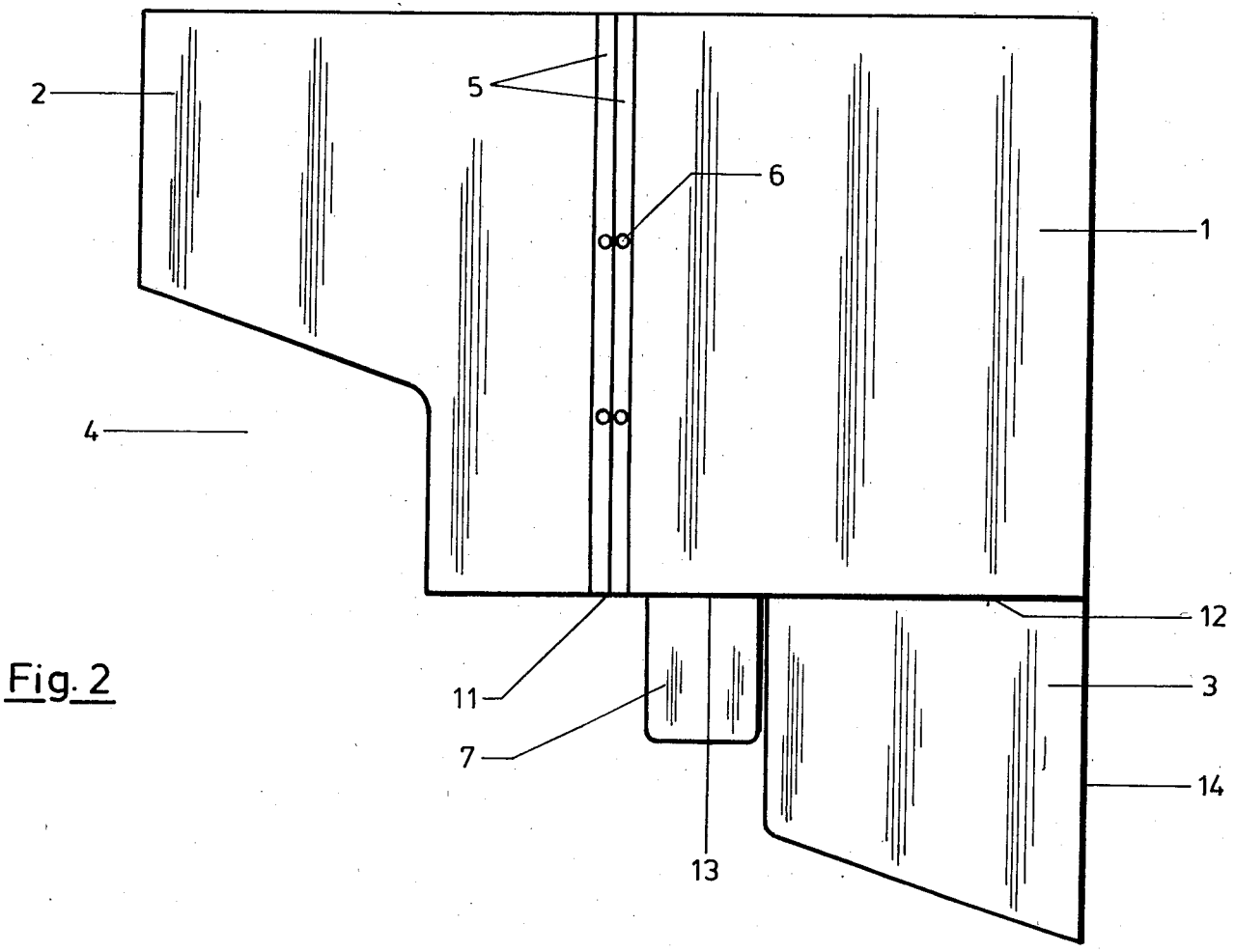

In the drawing:

FIG. 1 shows a plan view of an embodiment of a working folder according to the invention in the finished condition, and FIG. 2 shows a plan view of a blank for producing a working folder as shown in FIG. 1, in the stamped-out and grooved or notched condition.

The blank comprises the first and second cover panels 1 and 2 which are joined together by way of the fold edge 11 that is common thereto. Parallel to the fold edge 11, each of the cover panels 1 and 2 has a fixing edge 5 with the usual number of holes 6 for storage or binding in a filing arrangement.

The pocket panel 3 is connected to the cover panel 1 by way of the grooved or notched fold edge 12 and is adjoined by the labelling or marking strip or tab 7 which is separated from the pocket panel 3 but which is integrally connected to the cover panel 1 by way of the grooved or notched fold edge 13. Pocket panel 3 may be secured to cover panel 1 along edge 15.

The cover panel 2 has a cut-out portion 4 which substantially corresponds in shape to the pocket panel 3 but which is overlapped along the edge 9 by the cut-out portion, in the region 8.

In the condition of the folder as shown in FIG. 1, the view is from the front on to the cover panel 2. However, visible in the cut-out portion in the cover panel 2 is the pocket panel 3 which is disposed therebehind and which carries an imprint 10 for labelling or marking thereon. The labelling or marking can be read without sheets, with the folder in the closed and in the open condition. In FIG. 1, the labelling or marking strip or tab is already in the folded-out condition. For transportation purposes however, it is folded inwardly between the two cover panels 1 and 2. If required, the strip or tab 7 may also be entirely omitted, which provides an additional saving in material, as two blanks which are positioned in opposite relationship can be moved closer together on a sheet.

The working folder according to the invention generally comprises strong paper or cardboard but it will be appreciated that it may also comprise another sheet material such as plastics film or foil.

I claim:

1. A working folder comprising first and second cover panels, said panels being connected together along one of their edges to form a common fold edge, said folder including a pocket panel which together with the first cover panel forms an insertion pocket in said first cover panel, and a cut-out portion in said second cover panel, said pocket panel being integrally connected to said first cover panel by a fold edge along at least a part of an edge of said first cover panel to said first cover panel along at least one further edge of said first cover panel, the edge of said cut-out portion circumscribing the peripheral edge of the pocket panel when said first and second cover panels are folded one upon the other.

2. The folder of claim 1 wherein said pocket panel and said cut-out portion are of a trapezoidal configuration, the bases of said trapezoidal configuration being disposed parallel to the common fold edge of the two cover panels, one other side of said trapezoidal configuration being normal to one of the trapezoidal bases and forms the fold edge by way of which the pocket panel is connected to the first cover panel.

3. The folder of claim 2 wherein the pocket panel extends only over a part of the edge of said first cover panel adjoining the common fold edge of the two cover panels, said folder including a marking tab integrally connected to at least a part of the remainder of said edge of said first cover panel.

4. The folder of claim 1 wherein the pocket panel extends only over a part of the edge of said first cover panel adjoining the common fold edge of the two cover panels, said folder including a marking tab integrally connected to at least a part of the remainder of said edge of said first cover panel.

5. The folder of claim 1 wherein the edge of said cut-out portion overlaps at least one edge of said pocket panel when said first and second cover panels are folded one upon the other.

6. The folder of claim 5 wherein said pocket panel and said cut-out portion are of a trapezoidal configuration, the bases of the trapezoidal configurations are disposed parallel to the common fold edge of the two cover panels, one other side of said trapezoidal configurations being normal to one of the trapezoidal bases and forms the fold edge by way of which the pocket panel is connected to the first cover panel.

7. The folder of claim 6 wherein the pocket panel extends only over a part of the edge of said first cover panel adjoining the common fold edge of the two cover panels, said folder including a marking tab integrally connected to at least a part of the remainder of said edge of said first cover panel.

8. The folder of claim 5 wherein the pocket panel extends only over a part of the edge of said first cover panel adjoining the common fold edge of the two cover panels, said folder including a marking tab integrally connected to at least a part of the remainder of said edge of said first cover panel.

9. The folder of claim 5 wherein the edge of said cut-out portion overlaps the edge of said pocket panel over a width from about 0.5 to about 3 cm.

10. The folder of claim 5 wherein the edge of said cut-out portion overlaps the edge of said pocket panel over a width from about 1 to about 2 cm.

* * * * *

UNITED STATES PATENT AND TRADEMARK OFFICE

CERTIFICATE OF CORRECTION

PATENT NO. : 4,583,764

DATED : April 22, 1986

INVENTOR(S) : Fritz Steffen

It is certified that error appears in the above-identified patent and that said Letters Patent are hereby corrected as shown below:

Column 4, lines 52 and 53, "...said first cover panel to said first cover panel..." should read ..said first cover panel, said pocket panel being secured to said first cover panel...

Signed and Sealed this

Twenty-ninth Day of July 1986

[SEAL]

Attest:

DONALD J. QUIGG

Attesting Officer

Commissioner of Patents and Trademarks